United States Patent [19]

O'Daniels

[11] 4,276,884

[45] Jul. 7, 1981

[54] BRASSIERE

[76] Inventor: Avis K. O'Daniels, 3801 Marquette Pl., San Diego, Calif. 92106

[21] Appl. No.: 78,012

[22] Filed: Sep. 24, 1979

[51] Int. Cl.[3] ..... A41C 3/02

[52] U.S. Cl. ..... 128/510

[58] Field of Search ..... 128/510, 509

[56] References Cited

U.S. PATENT DOCUMENTS

| | | | |
|---|---|---|---|
| 2,255,720 | 9/1941 | Lewis | 128/510 |
| 2,363,017 | 11/1944 | Plehn | 128/510 |
| 2,581,036 | 1/1952 | McIlhinney | 128/510 |
| 3,935,865 | 2/1976 | Newmar | 128/494 |

FOREIGN PATENT DOCUMENTS

| | | | |
|---|---|---|---|
| 642764 | 9/1950 | United Kingdom | 128/510 |

*Primary Examiner*—Doris L. Troutman

*Attorney, Agent, or Firm*—Henri J. A. Charmasson

[57] ABSTRACT

A brassiere comprising two breast-receiving cups, a halter-type strap having its opposite ends connected to respective cups extending over the wearer's shoulders with a median section lying horizontally across the wearer's back and tensioned by two lateral straps connecting said halter-type strap to the back portion of the brassiere.

3 Claims, 3 Drawing Figures

BRASSIERE

BACKGROUND OF THE INVENTION

The present invention relates to female undergarments, and more particularly to brassieres especially fitted for nursing mothers and other full-bosomed individuals. With most commonly used brassieres most of the breast weight is supported by a pair of vertical shoulder straps which extend from the center top of each of the brassiere's cup over the mid-shoulder section and down the wearer's back where they connect with the dorsal part of the garment. The prolonged use of this type of brassiere by buxom females tends to cause the development of furrows in the soft midsection of the shoulders under the pull of the shoulder straps. After a few years the furrows may become a distressing permanent mark preventing the person from wearing shoulderless dresses and other revealing garments. The problem has been unsatisfactorily palliated in the past by providing brassieres with wider shoulder straps, sometimes heavily padded. However, these wide or padded straps tend to show through the outer garment and are usually shunned by the stylish womankind.

SUMMARY OF THE INVENTION

The principal object of this invention is to provide a brassiere wherein the path of the weight supporting shoulder straps is deflected outward by the bony section of the shoulder, above the end portion of the clavicle instead of the fleshy mid shoulder section area. It is also an object of this invention to provide a brassiere which prevents the formation of furrows in said shoulder section or which will allow pre-existing furrows to quickly disappear. Another object of the invention is to provide a brassiere which can be worn by a full-bosomed female under a outer garment widely open at the neck. Yet another object of the present invention is to provide such a brassiere with thin and narrow straps which will not show under the outer garments. These and other objects of the present invention are achieved by providing a brassiere with a halter type U-shaped strap having both ends connected to the breast receiving cup and extending over the shoulder and forming a horizontal section across the wearer's back, wherein the shoulder sections are deflected outwardly by a pair of tensioning straps anchored to the lateral rear sections of the brassiere.

DESCRIPTION OF THE PREFERRED EMBODIMENT OF THE INVENTION

Figure 1:
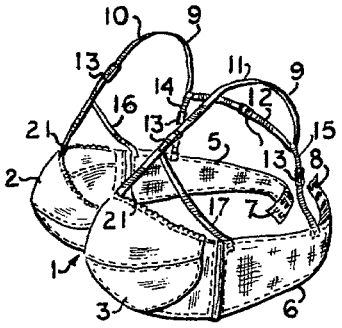
FIG. 1 is a perspective view of the brassiere.
Figure 2:
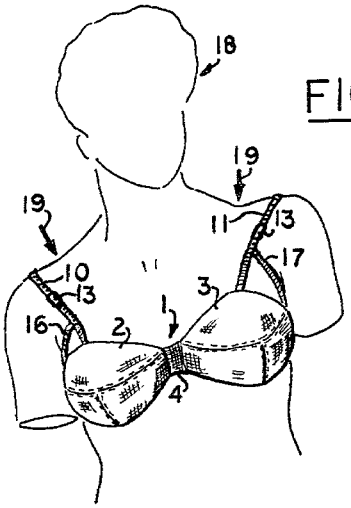
FIG. 2 is a frontal view of the brassiere fitted on a dummy.
Figure 3:
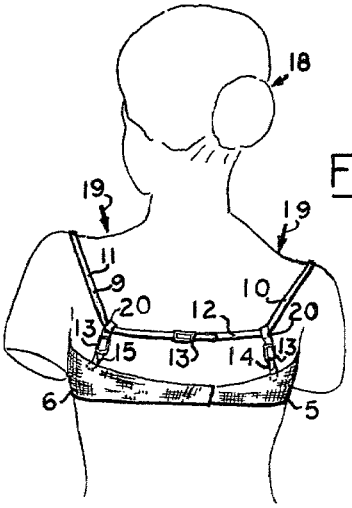
FIG. 3 is the dorsal view thereof.

Referring now to the drawing, and in accordance with the invention there is shown a brassiere 1 specifically designed for the comfort of full-bosomed females such as nursing mothers. The brassiere 1 comprises two breast receiving cups 2 and 3 attached together by a central piece 4. As in most conventional brassieres lateral straps 5 and 6 extend arcuately from the sides of the cups toward the middle of the wearer's back where they are interconnected by two or more rows of connecting fasteners 7 and 8. A halter-type strap 9 having each end 21 connected to the upper part of one of the cups 2 and

3 wraps around the shoulders of the wearer and form a horizontal median section 12 across the back extending from the lower end of one shoulder blade to the other. The shoulder sections 10 and 11 of the halter-type strap 9 are deflected outwardly by means of two tensioning straps 14 and 15 connected to the ends of the horizontal dorsal section 12 and anchored to the rear lateral portions of the dorsal straps 5 and 6. A pair of frontal deflecting straps 16 and 17 may also be provided when as is the case in the illustrated embodiments the cups 2 and 3 featured a very low upper profile. Various lengths adjusting buckles 13 are provided along the outer-type strap 9 and the tensioning straps 14 and 15. These various straps are adjusted so that the curved portions 10 and 11 of the main strap 9 do not rest against the soft, fleshy mid sections of the shoulders indicated by arrows 19 on the dummy 18, but are deflected outwardly until they rest on top of the more bony area near the end of the clavicle. This strapping arrangement leaves a broad area around the neck of the wearer which is free of any unsightly strap and particularly adaptable to the port of a dress with wide cleavage and broadly open neck. The connecting points 20 between the main strap 9 and the tensioning straps 14 and 15 should be fixed rather than slidable in order to guarantee the maintenance of constant tension on the horizontal section 12 of the main strap 9 and the tensioning straps 14 and 15. The various straps are preferably made of soft, slightly resilient material as would be provided by a tightly knit web of cotton threads. With certain types of brassieres, the cups are supported by an understructure made of rigid wires, and it may be preferable to connect the ends 21 of the main strap 9 on the lateral halves of the cups rather than the central top sections as shown in the Preferred Embodiment of the Invention. It should be understood that the dimensional relationship between the various straps vary according to the anatomical features of the particular wearers without departing substantially from the demensional outlines of the preferred embodiment of the invention.

While I have described the preferred embodiment of the invention and suggested some modifications thereto other embodiment may be designed and modifications may be made thereto without departing from the spirit of the invention and the scope of the appended claims.

What is claimed is:

1. A brassiere which comprises:

two breast-receiving cups in side-by-side relation;

means for frontally attaching together said cups;

a halter-type strap having its opposite ends connected to respective cups, said strap extending over the wearer's shoulders and having a median section spread horizontally across the wearer's back;

a pair of dorsal straps, each strap of said pair being attached laterally to one of said cups and extending horizontally and arcuately into the middle of the wearer's back;

means for attaching the free ends of said dorsal straps together;

at least one pair of tensioning straps adjoining said halter-type strap to said dorsal straps, said tensioning straps having one of its extremities connected to the end of the horizontal median section of the halter-type strap and the other extremity connected to the rear lateral section of one of the dorsal straps; and said tensioning straps and said halter-type strap are positioned and dimensioned so that said horizontal median section extends generally from the lower end of one of the wearer's shoulder blades to the other, whereby the sections of the halter-type strap rest on top of the area above the lateral ends of the wearer's clavicles.

2. The brassiere claimed in claim 1 wherein said tensioning straps further comprise a pair of auxiliary straps, each one of said auxiliary straps extending from the joint area between a breast receiving cup and a dorsal strap of the frontal sections of the halter-type strap.

3. The brassiere claimed in claim 2 wherein each strap is made from a slightly resilient web of tightly knitted cotton threads.

* * * * *